US005610585A

United States Patent [19]

Jobe

[11] Patent Number: 5,610,585

[45] Date of Patent: Mar. 11, 1997

[54] SECURITY SYSTEM FOR PROTECTING AGAINST THEFT OF A GOLF BAG OR GOLF CLUBS THEREFROM

[76] Inventor: Kendall J. Jobe, 10015 S. Sheridan #312, Tulsa, Okla. 74133

[21] Appl. No.: 588,346

[22] Filed: Jan. 18, 1996

[51] Int. Cl.[6] ..... G08B 13/14

[52] U.S. Cl. ..... 340/568; 206/315.3

[58] Field of Search ..... 340/568, 571; 206/315.2, 315.3; 70/64

[56] References Cited

U.S. PATENT DOCUMENTS

| | | | |
|---|---|---|---|
| 4,023,157 | 5/1977 | Miller | 340/571 |
| 4,042,918 | 8/1977 | Klitzman | 340/568 |
| 4,489,314 | 12/1984 | Miller | 340/568 |
| 4,509,643 | 4/1985 | Rhee | 206/315.3 X |
| 4,538,728 | 9/1985 | Lewis | 206/315.3 |
| 4,833,456 | 5/1989 | Heller | 340/571 |
| 4,863,019 | 9/1989 | Lewis et al. | 206/315.3 |
| 4,881,638 | 11/1989 | Cho | 206/315.3 |
| 4,955,472 | 9/1990 | Yamazoe | 206/315.3 X |
| 5,004,100 | 4/1991 | Smith | 206/315.2 |
| 5,041,815 | 8/1991 | Newton | 340/568 |
| 5,058,909 | 7/1991 | Miller | 340/568 |
| 5,222,596 | 6/1993 | Jordan | 206/315.3 X |
| 5,493,274 | 2/1996 | Long | 340/568 |

FOREIGN PATENT DOCUMENTS

| | | | |
|---|---|---|---|
| 2148248 | 5/1985 | United Kingdom | 3440 571 |

*Primary Examiner*—Thomas Mullen
*Attorney, Agent, or Firm*—Head, Johnson & Kachigian

[57] ABSTRACT

A system is provided for protecting a golf bag and golf clubs including a shock sensor having an audio signal generator and means for arming and disarming the sensor. An elongated strap is used in conjunction with the shock sensor. In one embodiment, the strap is attached to the shock sensor and may be looped around golf clubs extending out of the top of the golf bag. In another embodiment, the shock sensor is affixed to the golf bag, and in such event a strap may be employed to encompass the golf clubs within the golf bag so that any attempt by a thief to remove a golf club will activate the shock sensor and provide a warning signal.

9 Claims, 3 Drawing Sheets

SECURITY SYSTEM FOR PROTECTING AGAINST THEFT OF A GOLF BAG OR GOLF CLUBS THEREFROM

REFERENCE TO PENDING APPLICATIONS

This application is not related to any pending applications.

REFERENCE TO MICRO-FICHE APPENDIX

This application is not referenced in any microfiche appendix.

BACKGROUND OF THE INVENTION

The theft of golf bags and golf clubs left unattended by golfers at golf courses, country clubs, and the like has become a serious problem. Golfers frequently leave their golf bags, with their golf clubs therein, unattended while waiting for a tee off, during lunch breaks and so forth. It is therefore easy for a thief to unobtrusively remove a club from a golf bag or to walk off with the entire bag.

To reduce thefts of golf clubs from golf bags, others have provided security devices and systems exemplified in the following United States Patents:

| U.S. Pat. No. | INVENTOR | TITLE |
|---|---|---|
| 4,042,918 | Klitzman | Apparatus Indicating An Absent Golf Club |
| 4,489,314 | Miller | Golf Club Monitor |
| 4,538,728 | Lewis | Golf Bag Security Device |
| 4,863,019 | Lewis et al. | Golf Bag Lock |
| 5,004,100 | Smith | Golf Club and Bag Security Device |
| 5,028,909 | Miller | Golf Bag Alarm |
| 5,041,815 | Newton | Golf Bag Security Alarm System |

The systems and devices of these previously issued patents all have desirable features but have various limitations that have kept any of them from coming into common usage so that the problem of theft of golf clubs and golf bags persists.

It is therefore an objective of this disclosure to provide an improved security system for golf bags and golf clubs that will more effectively prevent theft while golf bags are left unattended.

BRIEF SUMMARY OF THE INVENTION

A security system is provided for protecting against theft of a golf bag or golf clubs from the golf bag, while the golf bag is left unattended. The golf bag is of the standard type, that is, it has a generally elongated tubular construction having a tubular sidewall and, on the exterior of the tubular sidewall, straps or handles for carrying the golf bag. The golf bag has an open top adapted to receive a plurality of golf clubs which, in the usual manner, partially extend above the open top of the bag. Typically, golf clubs are placed in the golf bag handle end first with the club end extending exteriorly above the top of the bag so that it is convenient for golfers to select the club needed for each shot.

A shock sensor having a housing and an audio signal generator is affixed to the golf bag and preferably to the exterior of the tubular wall adjacent the open top end. The shock sensor has an audio signal generator, that is, a means of producing a loud audio signal such as a shrill whistle sound, a pulsating high pitch sound or otherwise as is common for alarm devices. The shock sensor is of the known type which is actuated when moved or by shock or vibration.

The shock sensor has an arming switch or button and a disarming switch or button. The sensor also has an automatic delay when armed (such as 2 or 3 seconds) before the alarm can be actuated after it is armed.

The golf bag thus equipped can be left unattended and the user after placing the golf bag on a resting surface, such as while waiting for a tee off or while having lunch or refreshments, can then actuate the alarm by an arming button or switch. After being armed, the shock sensor will detect any movement, shock or vibration of the golf bag and actuate an audio signal to thereby give warning that the movement, shock or vibration may be as a consequence of an attempted theft. When an audio signal is given, the owner of the golf bag will be apprised and can disarm the sensor to terminate the audio signal.

The sensitivity of the shock sensor can be adjusted so that the bag will be disturbed if an attempt is made to remove a club from the bag rather than attempting to move the entire bag. In this way protection is given against not only theft of the entire bag with the contents but also against the theft of an individual club or clubs which a thief may attempt to extract from the bag.

To further guard against the possibility that a club could be removed from the bag without disturbing the bag sufficient to actuate the shock sensor, this invention provides improved means of insuring that the attempt by a thief to remove the club will actuate a shock sensor attached to the bag. For this purpose, an elongated flexible strap is secured by one end to the bag. The opposite end of the strap has a first Velcro member, and a second Velcro member is secured to the bag. The user can then loop the strap around the golf club extending out the open top of the bag and attach the loose end to the Velcro strip that is secured to the bag.

In a still more preferred arrangement, the bag tubular sidewall is provided with a slot therethrough adjacent the upper open end. A strap has one end affixed to the bag, preferably on an interior surface of a sidewall. The strap loops around the golf clubs positioned within the bag and the second end extends through the slot to the exterior of the bag. A first Velcro member is secured to the strap adjacent the second end, and a second Velcro member is affixed to the exterior of the bag. In this way, the user can draw the strap through the slot to closely encompass golf clubs positioned in the bag and then attach the Velcro member at the second end of the strap to the Velcro member on the bag. This insures that it will be impossible to remove a golf club from the bag without disturbing the bag's position and to actuate the shock sensor to thereby turn on the audio signal to warn the owner that a theft is being attempted.

A better understanding of the invention will be obtained from the following description of the preferred embodiments, taken in conjunction with the attached drawings.

DESCRIPTION OF THE DRAWINGS

FIG. 1 shows one embodiment of a security system of this invention including a shock sensor having a strap extending therefrom that is looped around the golf clubs. Any attempt to move the golf bag or any of the golf clubs encompassed within the strap will actuate the shock sensor to activate an audio signal indicating an attempted theft.

FIG. 2 also shows an improved aspect of the system in which a flexible strap is secured around the golf clubs to make it more difficult to remove one or more of them from the golf bag and to thereby insure that an attempt to remove any golf club from the bag will actuate the shock sensor.

In FIG. 3, the second end portion of the strap is not shown. FIG. 3 further shows the use of a buckle that can be employed to secure the strap together illustrative of the fact that the strap can then be attached either by a Velcro system, buckle or otherwise in practicing the invention.

DETAILED DESCRIPTION OF THE PREFERRED EMBODIMENTS

Figure 1:
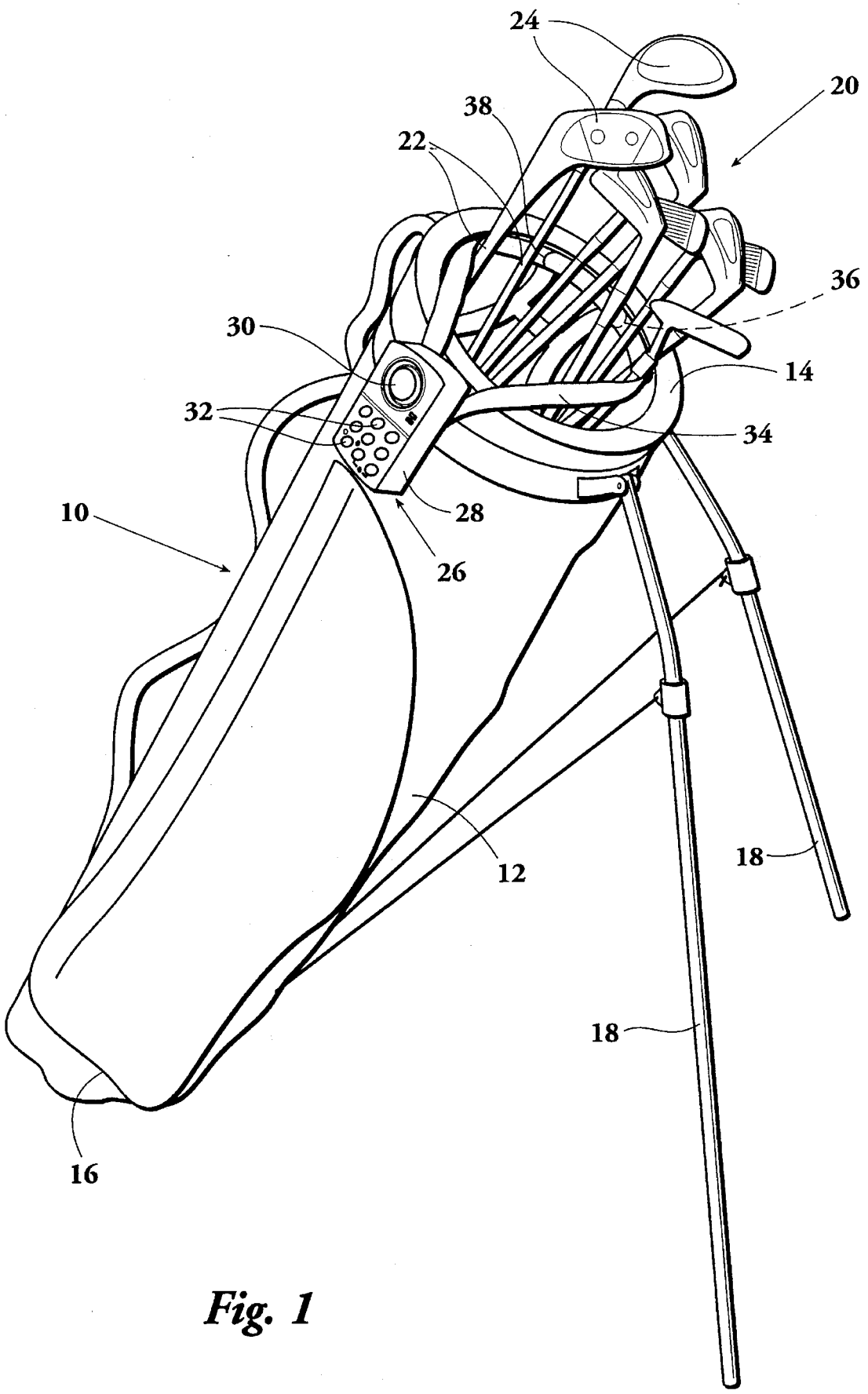
FIG. 1 is an isometric external view of a golf bag having a plurality of golf clubs extending from the upper end thereof, the golf bag is shown with leg supports as is commonly employed to enable the golf bag to be left standing when not in actual use.

FIG. 1 illustrates a typical golf bag 10 of the type commonly employed by golfers. The bag 10 includes an elongated tubular sidewall 12 having an open upper end 14 and a closed bottom 16. The bag 10 is shown with pivotal legs 18 that are sometimes employed with the bag to permit the bag to be stowed in a temporary position in which the bag is substantially upright. When the bag 10 is lifted off of the ground or other rest surfaces, legs 18 automatically fold adjacent to sidewall 12. The specific construction of bag 10 and the use or non-use of legs 18 are not germane to the invention that is enclosed herein but are representative of the state of the art.

Extending from the upper open end 14 of bag 10 are a plurality of golf clubs, generally indicated by numeral 20. Golf clubs have a shaft portion 22 and a head portion 24. Golf clubs 20 are typically stored in bag 10 as indicated, with the shaft portions having the handle area (not shown) on the opposite end and with the head portions 24 extending above the open top of the bag. This arrangement simplifies the ready selection of the appropriate club by a golfer as needed.

All aspects of FIG. 1 described to this point are intended to be typical and representative of a golf bag having golf clubs therein as customarily employed by a golfer. The actual construction, appearance and arrangement of golf bag 10 can vary considerably, however, the purpose of this invention is to provide a means of reducing the possibility of theft of golf bag 10 or theft of individual golf clubs 20 as stowed in a golf bag. For this purpose, a shock sensor, generally indicated by the numeral 26, is included having a housing 28 containing electronic circuitry (not shown) capable of detecting shock, motion or vibration. Housing 28 has, as a portion thereof, an audio signal generator 30 usually consisting of a diaphragm that is actuated to create an audio signal. Shock sensor 26 further has means for arming and for disarming the shock sensor indicated by buttons 32. Shock sensor 26 preferably is arranged so that buttons 32 must be depressed in a selected sequence to either arm or disarm it. In this way, a thief cannot readily disarm the shock sensor by compressing a single button.

Further, shock sensor 26 preferably includes an automatic time delay so that it will not be activated until a few seconds have elapsed after arming.

Figure 3:
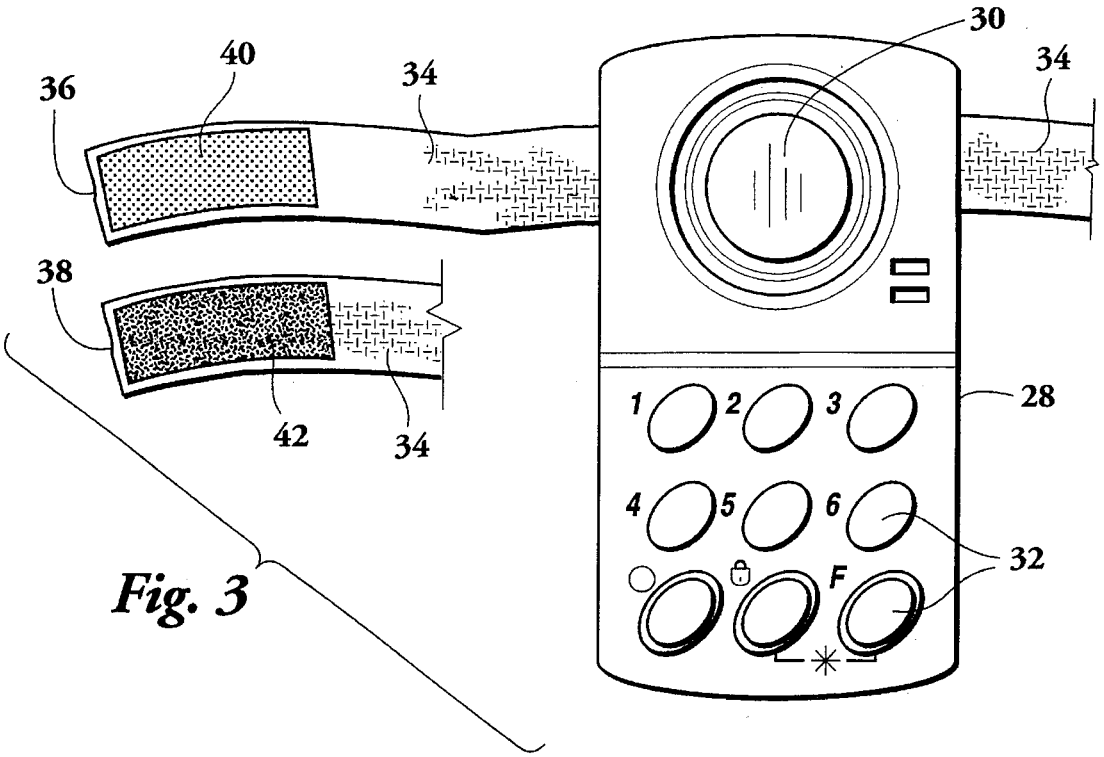
FIG. 3 is an enlarged external view of a shock sensor that is affixed to a strap as employed in the embodiment of the invention as illustrated in FIG. 1 wherein the shock sensor is not permanently attached to the golf bag but can be secured by means of the strap around golf clubs extending through the bag.

FIG. 3 shows an enlarged elevational front view of shock sensor 26. This view is not intended to be a pictorial representation of how a shock sensor must appear to be within the scope of this invention but is merely emblematic of a shock sensor that satisfies the requirements of the invention. Buttons 32 may be replaced by switches, or the buttons may be varied in number and arrangement. The function of buttons 32 is to enable the user to input a short code, consisting of two or three numbers in sequence, to arm or disarm the shock sensor. Buttons 32, or other control devices, may be employed to control volume, duration, or repetitive sequence of an alarm sound—all of which is within the scope of the skilled electrical engineer concerned with designing and manufacturing shock sensors.

Returning again to FIG. 1, an elongated strap 34 is secured to the shock sensor housing 28 such as to the rearward surface of the housing. The strap 34 has, as shown in FIG. 3, a first end 36 and an opposed second end 38. Adjacent first end 36 is a first Velcro member 40 which may be, by example, the type of Velcro member formed of closely spaced plastic filaments cut to have an integral hook at each end. Adjacent the strap second end 38 is second Velcro member 42 which, by example, may be of the type of looped pile that removably receives the closely spaced hooks of Velcro member 40. In the arrangement of FIG. 1, strap 34 is extended around golf clubs 20 with the Velcro portions (not seen) secured to each other. FIG. 1 shows the strap second end 38, the first end 36 being in dotted outline since it is behind the strap.

The embodiment of FIGS. 1 and 3 of the invention provides a portable device that can be employed by a golfer. When the golfer has positioned his bag in a rest position, such as shown in FIG. 1, he can expeditiously extend strap 34 around the golf clubs 20 extending out the top of bag 10 and secure the strap ends together with the Velcro system.

After the shock sensor 26 is in place and positioned by strap 34, the user can arm the sensor by depressing buttons 32. Thereafter, any movement of the bag 10 or any effort to remove a golf club from the plurality of clubs 20 will cause sufficient shock, movement or vibration to activate shock sensor 26 to thereby cause the audio signal generator to indicate an attempted theft.

When the security device is not needed, the Velcro portions can be unleashed from each other, and housing 28 with its attached strap 34 may be stowed, such as in a compartment (not shown) on bag 10.

The arrangement of the device provides an easy means wherein one attachment, that is, around the assembly of golf clubs, functions not only to protect the golf clubs individually but the bag itself, since any attempt to remove the bag or a golf club will set off a warning notice.

Figure 2:
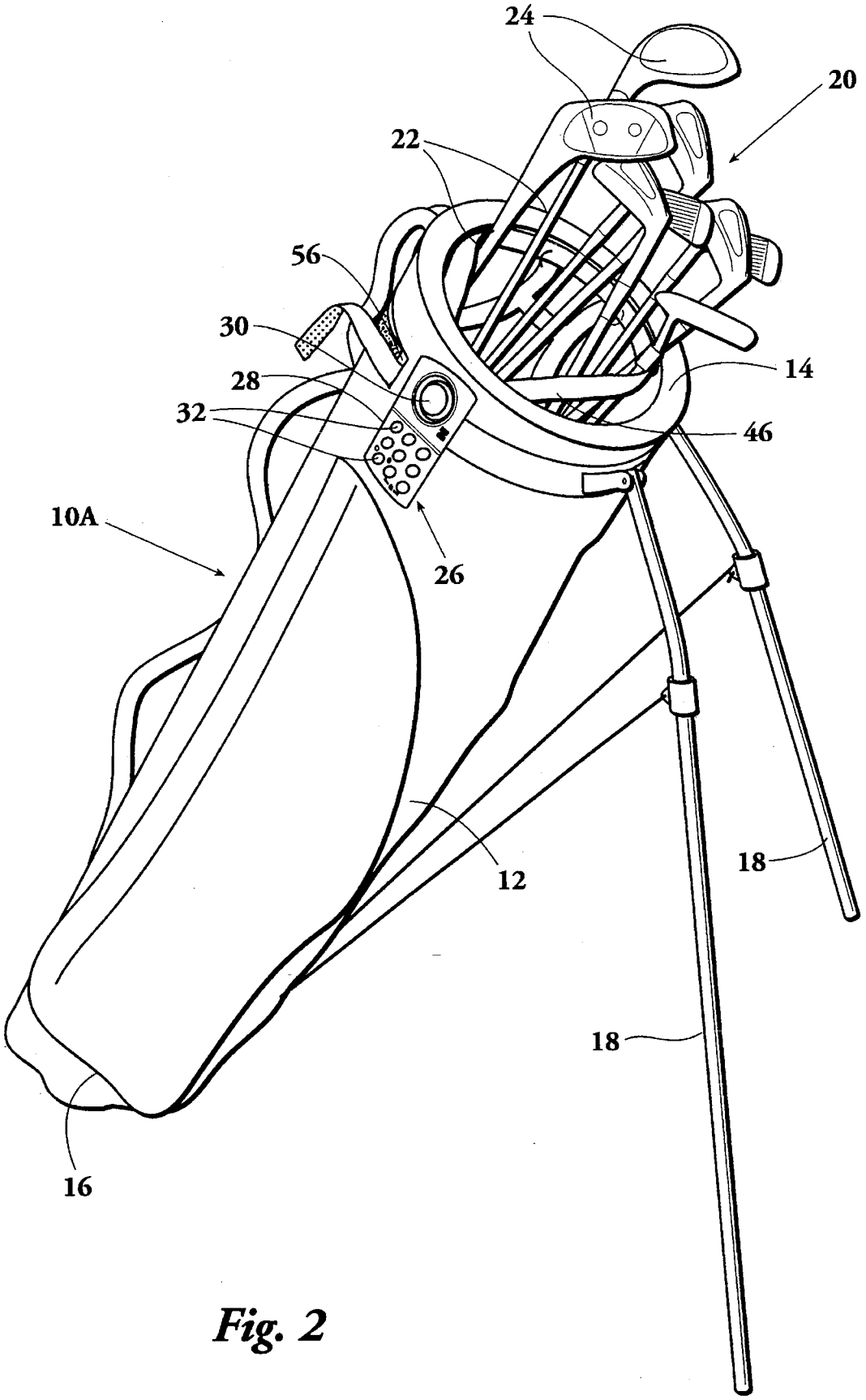
FIG. 2 is an isometric elevational view of a golf bag similar to that of FIG. 1 but showing an alternate embodiment of the invention in which the shock sensor is permanently secured to an exterior surface of the golf bag.
Figure 4:
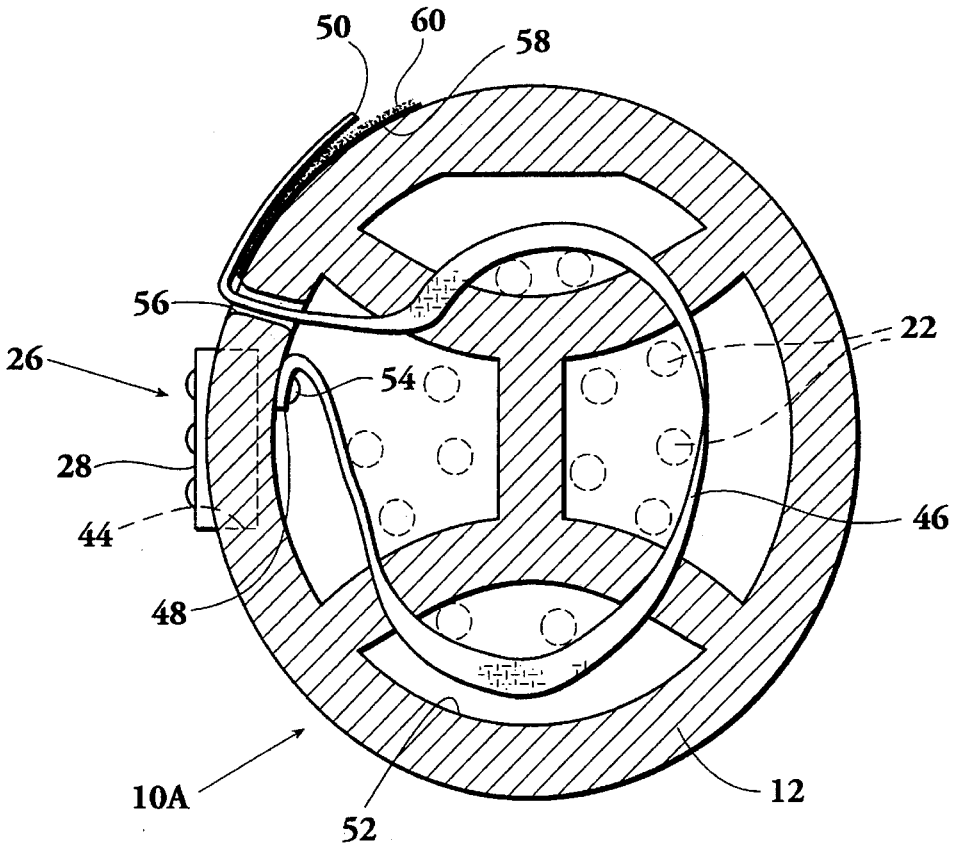
FIG. 4 is a cross-sectional view taken perpendicular to the longitudinal axis of the golf bag and showing more details of the arrangement of the strap that is employed to encompass the golf clubs. This cross-sectional view shows the slot formed in the sidewall through which the second end of the strap extends so that, by means of Velcro attached to the strap at the outer end and also to the exterior of the bag, the strap can easily be secured around the golf clubs within the bag.

FIGS. 2 and 4 illustrate a slightly alternate embodiment of the invention. As shown in FIG. 4, a cavity 44 is formed in the exterior surface of tubular sidewall 12 of golf bag 10A. The shock sensor housing 28 is positioned within cavity 44, and thus the shock sensor remains a part of golf bag 10A. With this arrangement, it is not necessary for the user to position the shock sensor on the golf bag in order to have security. All that is necessary is that when the bag is to be left unattended, the user actuates the correct buttons 32 to arm shock sensor 26 and upon displacement, shock or vibration of the bag, the audio signal generator will be actuated.

If the shock sensor 26 is set at a highly sensitive level, it will detect any attempt to remove any one of golf clubs 20. However, this invention also provides a means of further insuring that an attempt to remove a club will certainly set off shock sensor 26. This is accomplished by means, best illustrated in FIG. 4, of a strap 46 that is similar to strap 34 in most respects. Strap 46 has a first end 48 and a second end 50. The strap is affixed to the interior 52 of golf bag tubular sidewall 12 such as by means of a screw 54, and thus strap 46 remains semi-permanently secured to the interior of golf bag 10A.

A slot 56 is formed in sidewall 10 adjacent upper open end 14. The second end 50 of strap 46 extends through slot 56 so that the second end is exterior of the bag. A first Velcro member 58 is attached to one surface of strap 46 adjacent the second end 50. A second Velcro member 60 is formed on the exterior surface of housing 26 adjacent slot 56.

Using the system of FIGS. 2 and 4, a user, after setting his golf bag to rest as shown in FIG. 2, can loop strap 46 around the shaft portions 22 of clubs 20 extending upwardly from the bag. The strap second end 50 can then be drawn with sufficient tension to gently secure the clubs in a cluster and the second end 50 is secured to the Velcro second portion 60. In this way, clubs 20 are retained within the bag in such a way that the possibility of one of the clubs being removed from the bag without actuating shock sensor 26 is substantially eliminated.

The use of strap 46 with its Velcro portions 58 and 60 in combination with the slot 56 formed in the bag can be an independent source of security with or without shock sensor 26, that is, with the provision of strap 46 as illustrated in FIG. 4, the golf bag owner can very quickly form the strap around the clubs extending from the bag so that removing one or more of the clubs can not be quickly accomplished. Of course, a thief could disconnect the Velcro attachment to loosen the strap and remove a club or clubs if a shock sensor 26 is not employed, however, this requires the thief to undertake additional steps and therefore increases the possibility that theft will be noticed. A thief, noticing that preliminary steps are necessary before clubs can be removed, will be discouraged from such activity.

A typical golf bag has pockets or pouches provided to receive spare golf balls, tees, coins and other personal items. While such pockets or pouches are not illustrated it is apparent that the concepts of this invention would guard against theft of items stored in such pockets or pouches.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A security system for protecting against theft of a golf bag and/or golf clubs therefrom, the golf bag having an open top and a plurality of golf clubs partially extending out of the open top, comprising:

a shock sensor having a housing, an audio signal generator and means for arming and disarming the sensor;

an elongated strap having an intermediate portion and opposed first and second end portions, said shock sensor housing being attached to the strap intermediate portion, the strap being long enough to loop around a plurality of golf clubs extending out of a golf bag; and means to releasably secure said opposed first and second end portions of said strap to each other to retain said strap and thereby said shock sensor to said plurality of golf clubs whereby movement of said golf bag or one of said plurality of clubs will cause said audio signal generator to be actuated.

2. A security system for protecting against theft of a golf bag and/or golf clubs therefrom according to claim 1 wherein said means of releasably securing said opposed first and second end portions of said strap to each other includes Velcro means.

3. A security system for protecting against theft of a golf bag and/or golf clubs therefrom according to claim 1 wherein said shock sensor housing and strap are dimensioned so that said shock sensor housing remains exterior of said golf bag when said strap is looped around said plurality of golf clubs.

4. A carrier for golf clubs having protection against theft, comprising:

a golf bag of generally elongated tubular construction having a tubular sidewall and an open top adapted to receive a plurality of golf clubs which partially extend above the open top;

a shock sensor having a housing and an audio signal generator, the housing being affixed to said tubular sidewall;

means for arming and disarming said shock sensor whereby when armed said shock sensor will generate an audio signal in the event of shock, movement or vibration of said bag, and means to releasably secure golf clubs within said golf bag whereby the possibility of removal of one or more clubs from said golf bag without causing movement of said golf bag is reduced.

5. A carrier for golf clubs having protection against theft according to claim 4 wherein said golf bag sidewall has an exterior surface having a recess therein receiving said shock sensor.

6. A carrier for golf clubs having protection against theft according to claim 4, said securing means including an elongated flexible strap having a first and a second end, the first end being attached to said bag;

a first Velcro means being attached to said strap adjacent said second end; and a second Velcro means being attached to said bag, whereby said strap may be wrapped around a plurality of golf clubs extending out of said golf bag open top and then said first Velcro means removably attached to said second Velcro means whereby movement of said golf bag or one of said plurality of clubs will cause said audio signal generator to be actuated.

7. A carrier for golf clubs having protection against theft according to claim 4 wherein said golf bag has a slot in said tubular sidewall adjacent said open top, said securing means including:

an elongated flexible strap having a first and a second end, the first end being attached to said bag, the strap looping within the interior of said tubular sidewall and said second end extending through said slot to the exterior of said tubular sidewall;

first Velcro means affixed to said strap adjacent said second end; and second Velcro means affixed to said tubular sidewall on an exterior surface whereby said strap may be secured around golf clubs positioned within said bag, pulled through said slot and said first Velcro means removably attached to said second Velcro means to thereby make it difficult to remove a golf club from said bag without actuation of said shock sensor.

8. A carrier for golf clubs having protection against theft, comprising:

a golf bag of generally elongated tubular construction having a tubular sidewall and an open top adapted to receive a plurality of golf clubs which partially extend above the open top, the tubular sidewall having a slot therethrough adjacent said open top;

an elongated flexible strap having a first end and a second end, the first end being attached to said bag, the strap looping within the interior of said tubular sidewall and said strap second end extending through said slot to the exterior of said tubular sidewall;

first Velcro means affixed to said strap adjacent said second end; and second Velcro means affixed to the exterior surface of said tubular sidewall adjacent said open top whereby said strap may be secured around golf clubs positioned within said bag, pulled through said slot and said first Velcro means removably attached to said second Velcro means to thereby make it difficult to remove a golf club from said bag.

9. A carrier for golf clubs according to claim 8 including:

a shock sensor secured to said golf bag having an audio signal generator and means to arm and disarm said signal generator.

* * * * *